US006407322B1

(12) United States Patent
Küppers

(10) Patent No.: US 6,407,322 B1
(45) Date of Patent: Jun. 18, 2002

(54) TUNING DEVICE FOR A DRUM

(76) Inventor: Peter Küppers, Kaiserstiege 143, Gronau (DE), D-48599

( * ) Notice: Subject to any disclaimer, the term of this patent is extended or adjusted under 35 U.S.C. 154(b) by 0 days.

(21) Appl. No.: 09/600,817

(22) PCT Filed: Jan. 26, 1999

(86) PCT No.: PCT/DE99/00190

§ 371 (c)(1),
(2), (4) Date: Jul. 24, 2000

(87) PCT Pub. No.: WO99/38150

PCT Pub. Date: Jul. 29, 1999

(30) Foreign Application Priority Data

Jan. 27, 1998 (DE) ..... 198 02 803
Jan. 19, 1999 (DE) ..... 199 01 636

(51) Int. Cl.[7] ..... G10D 13/02
(52) U.S. Cl. ..... 84/411 R; 84/411 R; 84/421
(58) Field of Search ..... 84/411 R, 421, 84/411 A; D17/22, 99

(56) References Cited

U.S. PATENT DOCUMENTS 3,541,913 A 11/1970 Severino
4,416,181 A * 11/1983 Hartry et al. ..... 84/272
4,754,683 A 7/1988 Townsend et al.
5,375,500 A * 12/1994 Halpin ..... 84/413
5,377,576 A 1/1995 Good et al.
5,392,681 A 2/1995 Hall
5,404,785 A 4/1995 Belli
5,517,890 A * 5/1996 Cooperman ..... 84/411 R
5,675,099 A * 10/1997 Granatello ..... 84/411 R
6,069,307 A * 5/2000 Rogers ..... 84/411 R
6,166,311 A * 12/2000 Barrickman ..... 84/411 R

FOREIGN PATENT DOCUMENTS

DE 109902 9/1899
WO WO 95/28698 11/1995

* cited by examiner

*Primary Examiner*—Khanh Dang
*Assistant Examiner*—Kim Lockett
(74) *Attorney, Agent, or Firm*—James Creighton Wray; Meera P. Narasimhan

(57) ABSTRACT

Percussions instruments, especially drums, consist of a ring-shaped hollow form covered with hide or a resonant skin on the top and bottom. The skins are arranged in such a way that they can vibrate freely. To do this, a flexible tensioning device is used, whereby the tension of said skins can be adjusted by the percussionist during play. A tubular body integrated into the edge of the support in the form of a closed ring-shaped body is thus provided. Said body can be moved towards or away from the hollow form or the outer wall thereof. The tubular ring rests against the percussive ring on the U-shaped supporting edge like a stop and acts upon the edge of the skin. When the periphery of the tubular hose is modified, the described movement and tensioning of the skin occurs.

27 Claims, 4 Drawing Sheets

TUNING DEVICE FOR A DRUM

BACKGROUND OF THE INVENTION

The invention relates to a percussion instrument, especially drums serving as a rhythm instrument, with a hollow form and at least one skin that is tightly stretched across the hollow form, with the tension of the skin being adjustable and correctable with a tensioning device which has the design of an inflatable tubular body that can affect the edge of the skin either directly or indirectly and which on the one hand rests against the edge of the support, which is filled with plastic material and rests against or on the hollow form, and on the other hand rests against a percussive ring.

Such percussion instruments are very common musical instruments. They are the most important rhythm instruments. Drums, which belong to the percussion instrument group, consist of a frame or a hollow form with one or two skins covering them tightly. The skins can be glued on, fastened with nails or flocks. If the skin is supposed to be adjustable or the tension changeable, the skins are usually tightened with a ring or screws or by tying them down. The drums are operated by hand or with so-called sticks. A collar, i.e. a ring-shaped elevation at the edge (percussive ring), is provided especially when using drumsticks in order to achieve certain effects. Apart from sound variations that can be achieved this way, the player of such a percussion instrument is largely dependent on the tightening of the skin. It has proven disadvantageous to tighten the skin or the setting ring representing the edge of the skin only in certain points such as with the above-mentioned screws, which rest against a support ring that runs generally around the hollow form's center. These screws must be secured appropriately on the upper edge, which rests on the skin setting edge, which represents a complex design. It is particularly disadvantageous that the appropriate tension can only be achieved with a relatively small number of areas relative to the periphery, even if the tensioning frame that rests on the skin setting ring can serve to some extent as a balancing element. It is clear however that in all these familiar designs the skin cannot vibrate freely, but rather is squeezed in the respective edge areas and exposed to such tension that this leads to above-mentioned disadvantages. From U.S. Pat. No. 5,504,785 we know about drums where a basically arrow-shaped ring made of resin or similar materials is placed on the upper hollow form edge. The skin can be tightened around this ring, however it can serve at the same time also as percussive ring. This familiar solution shows that the skin is tightened in only a few areas relative to the periphery. This is due to a solution that involves hook tension screws. U.S. Pat. No. 5,392,581 on the other hand describes drums that are also equipped with several clamps throughout the periphery, but on which a tubular body is arranged between the percussive ring and the edge of the skin that can be filled with either compressed air or fluids and can also be emptied again appropriately. This makes it possible for the first time to tighten the skin in such a way that it is evenly tensioned, independent of the respective tensioning devices. Apart from the fact that an appropriate percussive ring is still placed on the top, which can impair the skin's flexibility, a particularly disadvantageous feature is represented by the fact that the compressed air or fluids are fed on one end of the tubular body, but also have to exit in the same place. The filling process is performed similar to that of a balloon. Thus it takes a certain amount of time for the tubular body to fill, and then there is also the risk that one cannot assure that there is really an evenly distributed pressure throughout the tubular body relative to the periphery. This in turn leads to the disadvantage that an even tightening of the skin is not guaranteed. And finally another disadvantage is the fact that the overall pressure that has to be applied and thus the tensioning effect are extremely low due to the arrangement and the design of the tubular body. Since it is located between the percussive ring and the edge of the hollow form or the supporting edge that is assigned to this hollow form edge, it can apply only relatively low amounts of force onto the skin that is to be tightened.

SUMMARY OF THE INVENTION

The invention is therefore based on the task of creating a percussion instrument on which the skin is always tightened evenly and sufficiently all the way around and can still vibrate optimally.

The task is resolved with the invention by designing the tubular body as a closed ring-shaped body that is integrated into the supporting edge.

The special design of the tubular body in the form of a closed ring-shaped body initially ensures that the tubular body expands or contracts appropriately over the entire edge of the skin so that even tensioning of the skin all the way around is guaranteed. Tensioning of the skin can also be safely achieved in the required areas because the tubular body or the closed ring-shaped body is integrated in the protective supporting edge. The supporting edge consists of an existing and familiar ring, made of aluminum or similar materials, into which an appropriate tubular body is now integrated instead of the plastic material. This allows the tubular body to expand or contract at the supporting edge so that it has a safe tightening or loosening effect on the edge of the skin all the way around.

A second useful version of the invention provides for the tubular body to simultaneously fasten the edge of the skin that is inserted into the U-shaped supporting edge. The edge of the skin can be placed into the U-shaped supporting edge and then the tubular body can be pressed in, with the latter being fastened when expanding the edge of the skin and ensuring that it not only remains tightened, but also remains seated safely in the U-shaped supporting edge. The skin itself is not influenced by the percussive ring or protruding ring so that it rests optimally on the edge of the hollow form and thus vibrates optimally. This results in the wealth of sounds desired by the percussionist and offers the opportunity of producing appropriate variations.

Both with regard to fastening the skin in the U-shaped supporting edge and with regard to resonance, it is beneficial if the tubular body and the skin are made of the same material, preferably a polyurethane resin (PUR) mass. Polyurethane is already being used today for skins so that the material as such is not new to percussionists, however its usage for fastening and connecting it to the tubular body, which is responsible for a tensioning of the skin, is.

Both from an assembly and from a performance point of view, it is particularly beneficial to design the tubular body and the skin as one component. During the manufacturing process of such a body, the connection for the compressed air hose or other connections can already be incorporated into the tubular body, and it would also be feasible to arrange a valve in this area in order to be able to release possibly exiting compressed air to the environment. Such a component can be mounted as described particularly easily because the tubular body can be placed simply into the U-shaped supporting edge so that the skin is fastened right away with the first expansion of the tubular body, while additional swelling of the tubular body then also appropriately tightens the skin as desired by the percussionist.

We also know of skins that consist of epoxy resins, which is a harder, less flexible material. Nevertheless, the necessary skin tensioning can be guaranteed if in accordance with the invention the skin consists of epoxy material and forms a unit with the tubular body, consisting of epoxy and PUR materials (hybrid). It would be feasible for the skin to consist of epoxy resin and the tubular body of the hybrid, but it would also be feasible to manufacture the tubular body only with PUR material, however this solution could cause problems when it comes to connecting it with the skin.

The tubular body, which rests in the U-shaped supporting edge, should have an even effect onto the edge of the skin, but also be able to expand, especially against the covering percussive ring. An optimal solution for the necessary function is one where the upper free wall of the tubular body has a greater expandability compared to the remaining walls. This increased expandability can be achieved e.g. with a lower wall thickness or with an appropriate material mixture. This causes the tubular body to expand, especially against the percussive ring, and to ensure that the skin is wrapped around the edge of the hollow form, tightened appropriately and can then be played optimally. It would also be a feasible solution if the supporting edge, consisting of aluminum or similar materials, allowed a widening of the design so that the tensile forces could be increased further.

In order to achieve optimal protection for the tubular body, the invention provides for the upper free wall to be covered by a flexible or somewhat flexible spoke plate. This in turn makes it possible to promote the tensioning process or to enable further expansion with this flexible spoke plate in order to increase the tensioning path, which permits optimal tensioning of the skin. Hereby a particularly useful and simple feature has been to equip the bottom of the percussive ring as the spoke plate. The expansion of the tubular body is specified by its embedding into the supporting edge and is performed in a specific manner.

Such percussion instruments are used as hand drums and, for example, in larger or smaller orchestra groups. Particularly in the latter application, it is beneficial if the tubular body is connected with a compressed air storage container or compressed air generator, while having the possibility of activating an inserted valve via a foot pedal that is part of the rhythm group. By connecting or disconnecting the compressed air storage container, the percussionist can thus ensure that the tension of the skin also changes during play, which is particularly interesting when it comes to sound variety.

The percussive ring in some way serves as a stop for the tubular body, which is seated in the U-shaped supporting edge. In a simple and useful manner it is fixed in such a way that it is placed against the outer wall of the hollow form with familiar fasteners. Depending on the size of the percussion instrument or the drums, fastening in four, eight or more areas throughout the periphery is sufficient. This can be accomplished with simple, familiar fasteners, which only have to hold the percussive ring in a particular position. More modern hollow forms of such percussion instruments are made of plastic. However, if wood or a less flexible material is used for the hollow form, it is beneficial if a semi-flexible ring made of PUR material or resin is placed onto the hollow form's edge. In such a design, the skin is run across the semi-flexible ring so that it comes close to a hollow form consisting of plastic material with regard to tensile forces, and especially sound effects. For optimal fastening, the semi-flexible ring can turn into an outer skin for the hollow body, with such semi-flexible rings being arranged on either side of the hollow form in the case of such percussion instruments.

In another version the skin extends beyond the edge of the hollow form and is equipped at the end with an arrow-shaped nose, which can be inserted into a supporting ring that runs around the hollow form and can thus be moved in the longitudinal direction of the outer wall of the hollow form as well as fastened with the ring-shaped body that is assigned to the supporting ring. Of course it would also be feasible to design the supporting ring similar to the U-shaped supporting edge, and to do so on both sides so that an appropriate ring-shaped body or tubular body can be arranged and fastened there as well in such a way that the skin, which is pulled down the appropriate length, can be seated and fastened under tension. Furthermore it would be feasible that the appropriate skin is not equipped with the usual skin setting ring at the end, but that the appropriate skin is equipped at applies an even load across the ring-shaped body or even two ring-shaped bodies and thus provides tension. It is beneficial if the effect of the even load handling ring-shaped body occurs directly onto the skin, i.e. without inserting any intermediate links.

Another similar version provides for the skin to turn into a peripheral skin setting ring or to be fastened to it, with the ring being connected with the arrow-shaped nose at the end via a tubular tension body that embraces the hollow form and being adjustable and relievable via the tubular body. In this version, the ring used is thus the generally known skin setting ring, which is connected with the ring-shaped body via the tension body, with the ring-shaped body's effect being exercised onto the skin setting ring via the support ring and thus onto the skin. The advantage here is that existing technology can be employed and considerable changes, especially with regard to the production of skin, are eliminated.

Optimal, even tension is possible if the tubular body, whose periphery can be changed, is arranged on either side of the arrow-shaped nose. Thus, two tubular bodies are inserted, a design that can be used both in the version with the continuous skin and in the version where the skin setting ring and the tension body are inserted.

The supporting ring that is used is placed against the outer wall of the hollow body in accordance with the state of the art. In doing so, the hollow body is generally penetrated so that screw heads or similar components can be located on the interior of the hollow form. Especially when the supporting ring is equipped with seats on both sides for the arrow-shaped noses of the tension body or when hollow bodies are located on both sides that are fastened in a different manner a fastening of the supporting ring can be foregone, if—as provided for in the invention—the supporting ring is connected with the outer wall of the hollow form only in certain points, preferably through racking fastening, or not at all and if the hide and resonant skin experience tension at the same time. The racking fastening will become necessary anyhow. Therefore, the wall of the hollow form is penetrated in order to be able to fasten the racking fastening effectively to the racking. The racking fastening is thus suited to fasten the supporting ring at least in certain points so that it cannot slide back and forth during assembly, but that its position is basically established. Once the arrow-shaped noses are inserted into the seats and the respective tubular body is "inflated," the supporting ring generally does not have to be fastened any longer so that the racking fastening serves only as an assembly facilitator.

The invention excels in particular because it creates a percussion instrument, particularly drums, which is equipped with a freely vibrating or optimally vibrating skin or two skins, which can therefore be optimally strained by the percussionist. It is also advantageous that the tension applied to the skin can be changed without difficulty by the percussionist himself during play without him having to interrupt his play. He just strains or inflates the tubular body more or less and thus applies higher or lower tensile forces onto the skin so that this provides the player with the opportunity of using his instrument optimally. Another advantage is that such a tension aggregate can also be realized for the optimization of existing percussion instruments because basically the filling of the supporting ring is replaced by the tubular body and appropriate fastening of the percussive ring as a stop is required in order to realize the beneficial invention. Therefore existing percussion instruments no longer have to be put aside, but instead they can be incorporated into the invented solution, which offers considerable advantages to the percussionist or player.

Further details and advantages of the object of the invention result from the following description of the appropriate drawing, in which a preferred version is depicted, along with the necessary details and components. It shows:

DETAILED DESCRIPTION

Figure 1:
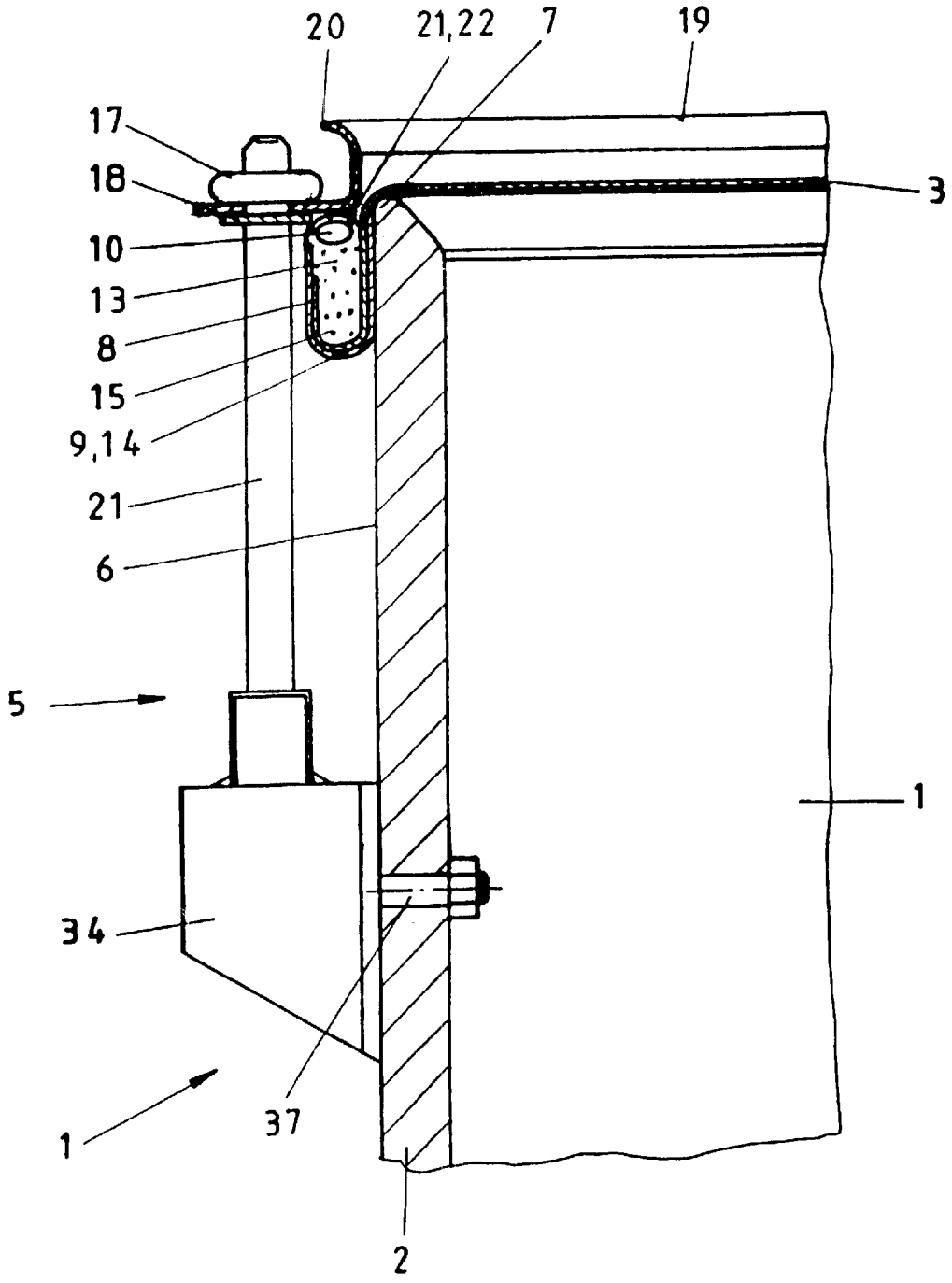
FIG. 1 cross-sectional view of drums with skin that is tightened over a tubular body, FIG. 2 enlarged picture of the U-shaped supporting edge, where the tubular body will be seated, with the inserted skin, FIG. 3 cross-sectional view of percussive ring, detailed picture with spoke plate, FIG. 4 cross-sectional view of drums with a semi-flexible ring as the edge of the hollow body and partial perspective view, FIG. 5 overall view of drums with double tubular bodies in a different version, FIG. 6 another version of tensioning design, and FIG. 7 cross-sectional view of tensioning design similar to that in FIG. 1.

The percussion instrument depicted in FIG. 1 involves drums 1 whose hollow form 2 has a ring-shaped design. The hide 3 is located at the upper hollow form edge 7, the so-called resonant skin 4 is located at the bottom edge; the resonant skin 4 however is not shown here, but only in FIG. 5. Both skins 3, 4 are subjected to load via a tensioning device or tensioning design 5, which has the same design on both sides of the hollow form 2 and is arranged on the outer wall 6 of the hollow form 2.

In accordance with FIG. 1, the hide 3 is pulled over the edge 7 of the hollow form or rests loosely against the hollow form edge 7. The edge 8 of the hide 3 and also the edge of the resonant skin 4 are formed by a skin setting ring 9, which offers the opportunity of arranging an appropriate tensioning device 5. The connection between the hide 3 and the skin setting ring 9 corresponds preferably to the state of the art.

According to FIG. 1, the skin setting ring 9 is equipped with a special design where a supporting edge 14 made of aluminum or similar materials is utilized, which is equipped with a filling 15 in the form of a tubular body 10. This tubular body 10 has the design of a continuous closed ring-shaped body 13.

The tubular body 10 or the ring-shaped body 13 is equipped with a wall 11, which can have the same thickness all the way around or different thicknesses, as will be explained further below.

Figure 2:
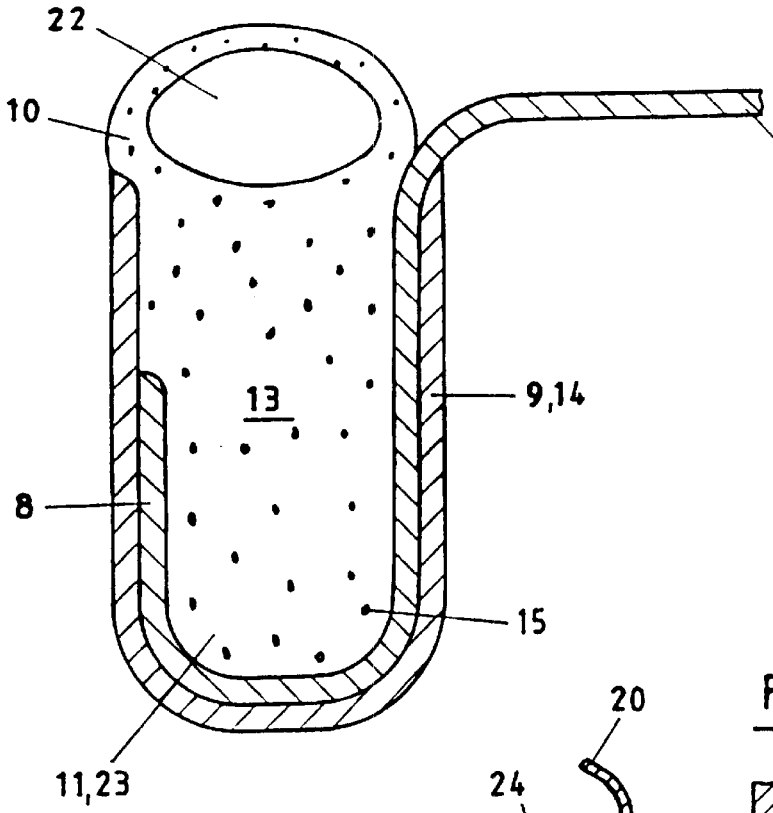

The tubular body 10 or ring-shaped body 13 fastens the edge 8 of the hide 3 in the U-shaped supporting edge 14, with this supporting edge being arranged and designed in such a way that it can be moved up and down along the outer wall 6 of the hollow form 2. It is possible, as shown in FIG. 2, to effectively fasten the tubular body 10 and the edge 8 of the hide 3 only by applying pressure onto the U-shaped supporting edge 14. It is also feasible for the tubular body 10 and the edge 8 of the hide or resonant skin 3, 4 to form a unit.

The tubular body 10 or the ring-shaped body 13 is connected with a compressed air storage container or compressed air generator (not shown). By actuating the foot pedal, for example, the valve that is assigned to the compressed air storage tank or compressed air generator or the connecting hose can be opened or closed. When opening the valve, the tubular body 10 inflates and rests against the U-shaped supporting edge 14 and the percussive ring 20. The percussive ring 20, with its flanged ring edge 19 in this example, is fastened to the outer wall 6 of the hollow body 2 via the fastener 21 in such a way that it serves, as described above, as a stop for the tubular body 10 or ring-shaped body 13. Here it is beneficial if the upper free wall 22 of the tubular body 10 has greater flexibility over the remaining walls 23. This increased flexibility can be achieved, for example, with a thinner design of the wall 22.

The fastener 21 is connected with a clamp 34, which in turn is fastened with the outer wall 6 via the locking screw 37. Other fastening possibilities are of course feasible and the complex design of the clamp 34 can be foregone because the fastener 21 does not necessarily have to be a screw.

FIG. 1 shows that the fastener 21 holds the percussive ring 20 in place with an upper ring plate 17 and a lower ring plate 18 in order to facilitate assembly.

Figure 3:
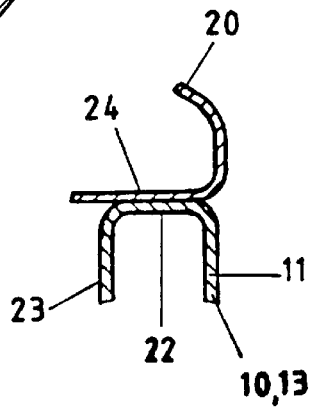

The bottom of the percussive ring 20 can be designed as a spoke plate 24, as indicated in FIG. 3. This spoke plate 24 makes it possible for the tubular body 10 to expand upward, initially to a limited extent, with the spoke plate 24 being flexible to a limited extent. This spoke plate 24 then bulges and results in a certain round shape of the tubular body 10 when it exercises appropriate force onto the edge 8 of the hide 3.

Figure 4:
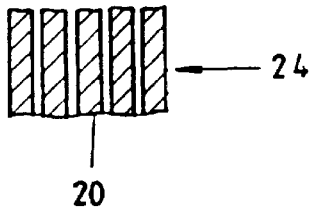
Figure 4:
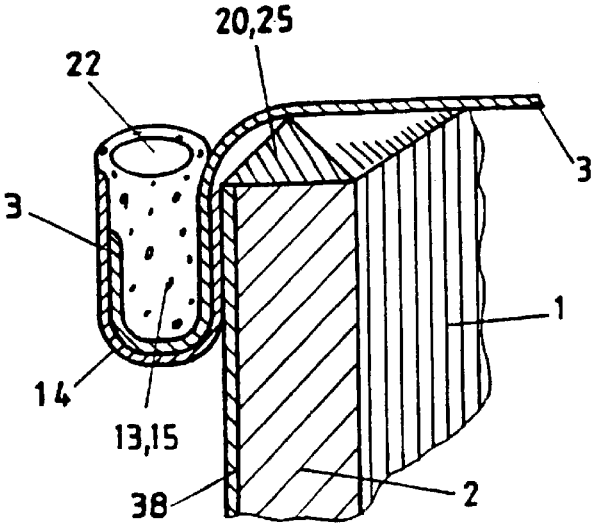

FIG. 4 differs with regard to the upper hollow form edge 7 in that it does not have a pointed design, but rather holds a semi-flexible ring 25, which for example turns into an outer wall resting area 38 in order to enable optimal fastening and locking of the semi-flexible ring 25. This semi-flexible ring 25 holds the skin 3 running across it and thus permits particularly favorable sound variations or the generation of appropriate sounds.

An even load or tension is applied to the skin setting ring 9 if it does not have the design of a tubular body but instead that of a fixed ring that basically rests against the upper hollow form edge 7 accordingly. This represents a useful version in that both the hide 3 and the resonant skin 4 are fastened evenly, both in the same supporting ring 27. The supporting ring 27 therefore is equipped not only with the seat 28, but on the opposite side 36 also with a seat 28' into which the arrow-shaped nose 31 can be inserted. Furthermore the picture shows that a load is applied onto both flanks 32, 33 of the respective arrow-shaped noses 26, 31 via the appropriate tubular bodies 10, 10'. This even load pulls the arrow-shaped noses 26, 31 more or less far into the seat 28, 28' in the longitudinal direction 29 of the outer wall 6 and fastens or loosens them. It would also be feasible to provide the hide 3 as such with such arrow-shaped noses 26, 31, or a tension body 30, as shown here, is inserted, which is equipped with the appropriate noses 26, 31.

Figure 6:
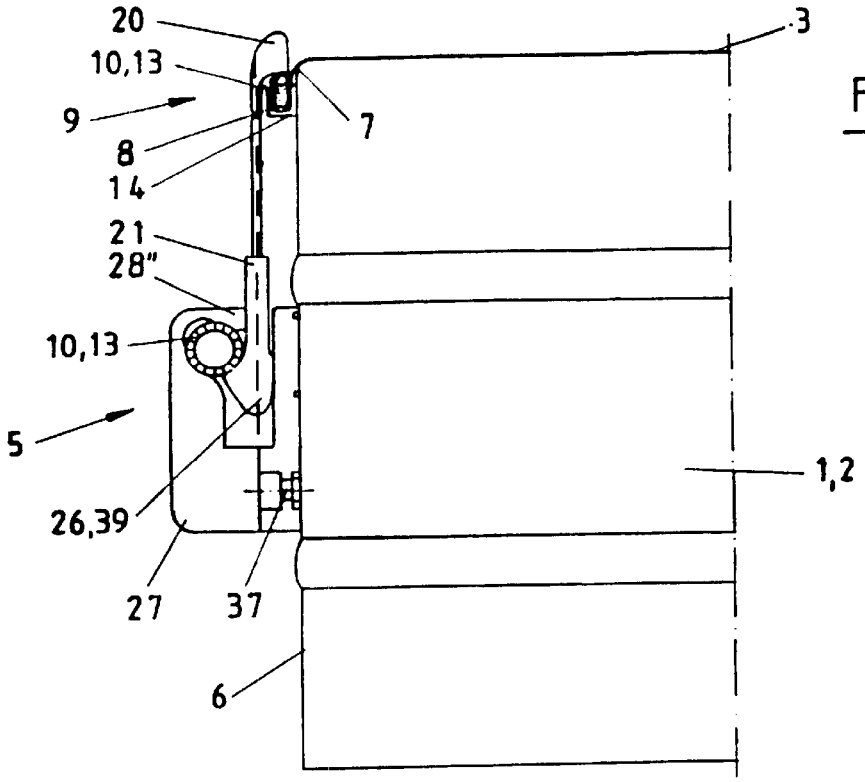
Figure 7:
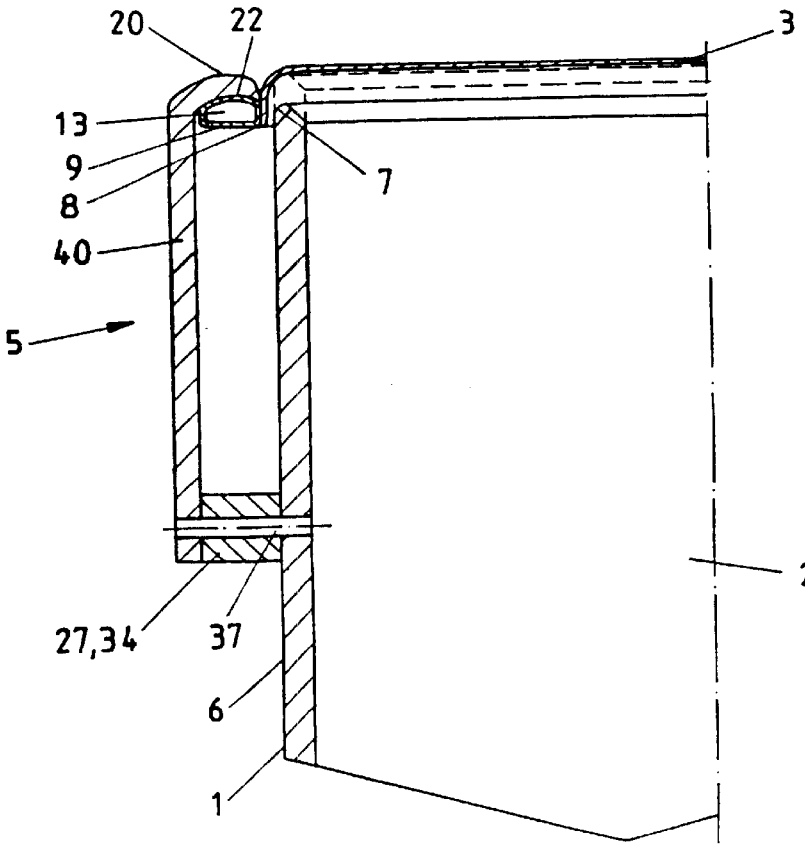

FIGS. 6 and 7 show additional versions, with an arrow-shaped nose being used in FIG. 6, however in the form of a pointy nose 39 onto which load is applied or which is pulled into the appropriate seat 28" only by a single tubular body 10. In this example, the percussive ring 20 also influences the skin setting ring 9 due to the tensile force of the tubular body so that the hide 3 is also tightened evenly. Additionally, FIG. 6 shows that the skin setting ring 9 is again equipped with a U-shaped supporting edge with an inserted tubular body 10 so that a double tensioning effect can be achieved should this be required or desired. It would also be feasible to incorporate only the upper tensioning device or only the lower tensioning device 5.

Figure 5:
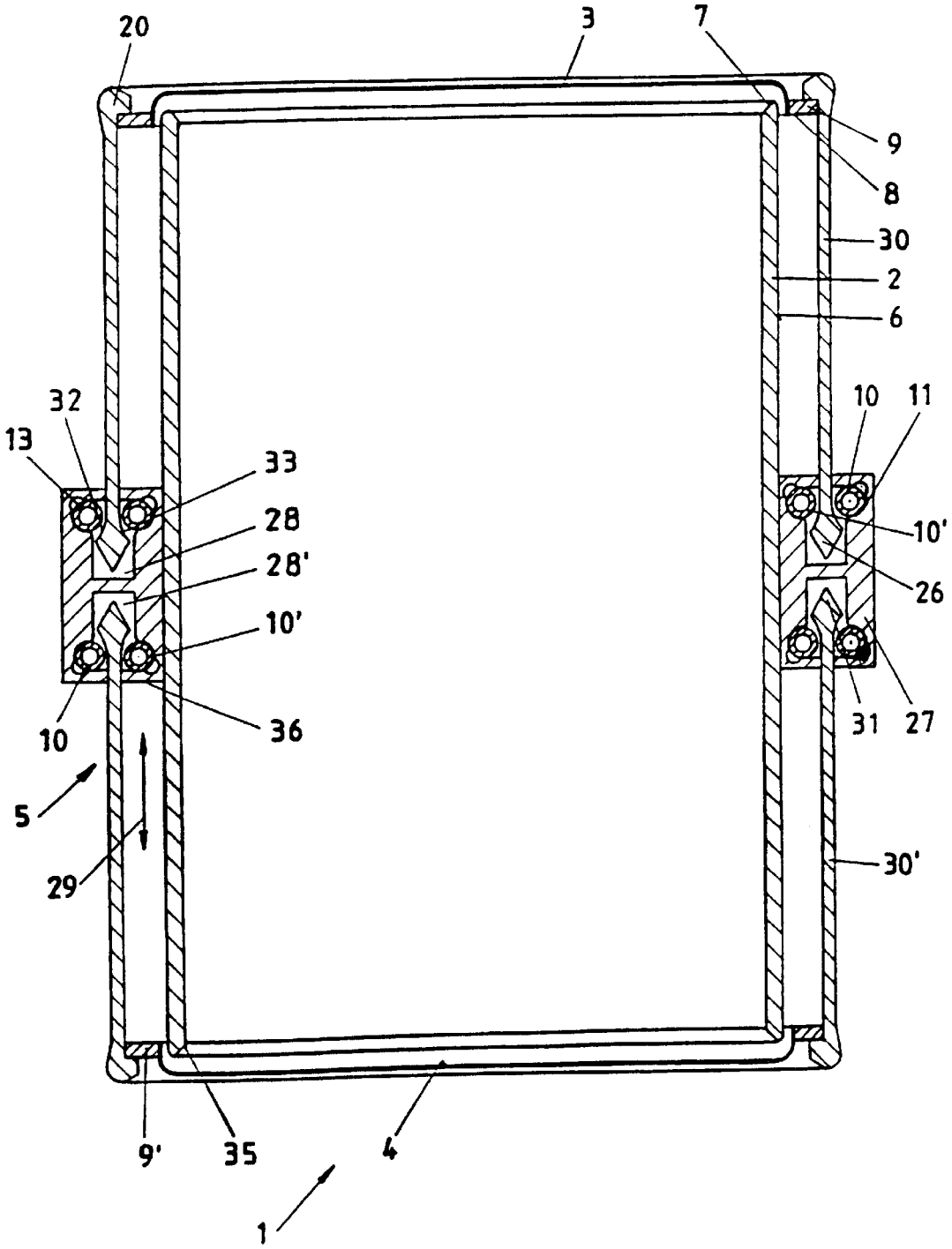

Of course, a tensioning device is also incorporated on the opposite 35 in the versions in FIG. 6 and even FIG. 7, as is the case in FIG. 5.

FIG. 7 then depicts a particularly simple and useful version, which is especially suited for hand drums, on which a peripheral holding ring 40 serves as a stop for the appropriately designed skin setting ring 9, while the skin setting ring 9 here is either equipped with an edge 8 in the form of a simple tubular body 10 or with the above-described shape with the supporting edge 14, which holds the ring-shaped body or tubular body 13, 10 and then either forms a unit with the edge 8 of the hide 3 or fastens it accordingly.

All features described here, also those that can only be derived from the drawings, are part of the invention, both by themselves and in combination.

What is claimed is:

1. Percussion instrument apparatus comprising a hollow body, at least one hide tightly stretched across the hollow body, a percussive ring, a tensioning device for adjusting and controlling tension of the at least one hide, the tensioning device comprising an inflatable tubular body acting on an edge of the hide, a support disposed between the hollow body and the percussive ring, wherein the inflatable tubular body and the edge of the hide rest in the support, wherein the tubular body is a closed ring-shaped body integrated into the support.

2. The apparatus of claim 1, wherein the instrument is a rhythm instrument.

3. The apparatus of claim 2, wherein the rhythm instrument is a drum.

4. Percussion instrument apparatus comprising a hollow body, at least one hide tightly stretched across the hollow body, a percussive ring, a tensioning device for adjusting and controlling tension of the at least one hide, the tensioning device comprising an inflatable tubular body acting on an edge of the hide, a support disposed between the hollow body and the percussive ring, wherein the inflatable tubular body and the edge of the hide rest in the support, wherein the support comprises plastic material filling.

5. The apparatus of claim 1, wherein the support is U-shaped.

6. The apparatus of claim 5, wherein the tubular body simultaneously fastens the edge of the hide resting in the U-shaped support.

7. The apparatus of claim 1, wherein the tubular body and the hide are of similar material.

8. The apparatus of claim 7, wherein the material is PUR.

9. Percussion instrument apparatus comprising a hollow body, at least one hide tightly stretched across the hollow body, a percussive ring, a tensioning device for adjusting and controlling tension of the at least one hide, the tensioning device comprising an inflatable tubular body acting on an edge of the hide, a support disposed between the hollow body and the percussive ring, wherein the inflatable tubular body and the edge of the hide rest in the support, wherein the tubular body and the hide are a unitarily formed component.

10. The apparatus of claim 9, wherein the hide is of epoxy material, and the tubular body is of epoxy and PUR material.

11. Percussion instrument apparatus comprising a hollow body, at least one hide tightly stretched across the hollow body, a percussive ring, a tensioning device for adjusting and controlling tension of the at least one hide, the tensioning device comprising an inflatable tubular body acting on an edge of the hide, a support disposed between the hollow body and the percussive ring, wherein the inflatable tubular body and the edge of the hide rest in the support, further comprising an upper free wall on the tubular body adjoining plural walls, wherein the upper free wall has greater expandability over the plural walls.

12. The apparatus of claim 11, further comprising spoke plate on the upper free wall.

13. The apparatus of claim 12, wherein the spoke plate is flexible.

14. Percussion instrument apparatus comprising a hollow body, at least one hide tightly stretched across the hollow body, a percussive ring, a tensioning device for adjusting and controlling tension of the at least one hide, the tensioning device comprising an inflatable tubular body acting on an edge of the hide, a support disposed between the hollow body and the percussive ring, wherein the inflatable tubular body and the edge of the hide rest in the support, wherein the percussive ring comprises a bottom formed as a spoke plate.

15. The apparatus of claim 1, further comprising a compressed air source connected to the tubular body.

16. The apparatus of claim 15, wherein the compressed air source is a compressed air storage container or compressed air generator.

17. The apparatus of claim 16, further comprising an actuatable valve coupled to the compressed air source.

18. The apparatus of claim 1, further comprising fasteners for fastening the percussive ring on an outer wall of the hollow body.

19. The apparatus of claim 1, further comprising a semi-flexible ring on an edge of the hollow body.

20. The apparatus of claim 19, wherein the semi-flexible ring is of resin material.

21. The apparatus of claim 20, wherein the resin material is PUR.

22. Percussion instrument apparatus comprising a hollow body, at least one hide tightly stretched across the hollow body, a percussive ring, a tensioning device for adjusting and controlling tension of the at least one hide, the tensioning device comprising an inflatable tubular body acting on an edge of the hide, a support disposed between the hollow body and the percussive ring, wherein the inflatable tubular body and the edge of the hide rest in the support, further comprising a support ring surrounding the hollow body, extensions on the hide extending beyond edges of the hollow body, and a first arrow-shaped nose on an end of the hide insertable into the support ring, wherein the tubular body is coupled to the support ring for moving the first arrow-shaped nose along longitudinal directions on an outer wall of the hollow body.

23. The apparatus of claim 22, further comprising a tubular tension body embracing the hollow body, a peripheral skin setting ring on the hide connected to the support ring by the tubular tension body, a second arrow-shaped nose on an end of the tubular tension body adjustably coupled to the support ring and the tubular body for tightening or loosening the tubular tension body via the tubular body.

24. The apparatus of claim 23, wherein the tubular body has changeable peripheries disposed on one of two flanks of the second arrow-shaped nose.

25. The apparatus of claim 24, further comprising spaced connections connecting the supporting ring to the outer wall of the hollow body.

26. The apparatus of claim 25, wherein the spaced connections have a racking fastening design.

27. The apparatus of claim 25, further comprising a resonant skin, wherein the hide and the resonant skin are adapted for being tightened simultaneously.

* * * * *